United States Patent [19]

Buettner

[11] Patent Number: 4,947,439

[45] Date of Patent: Aug. 7, 1990

[54] HEARING AID COMPRISING A CONTACT SPRING ARRANGEMENT

[75] Inventor: Gerhard Buettner, Gorssenseebach, Fed. Rep. of Germany

[73] Assignee: Siemens Aktiengesellschaft, Berlin and Munich, Fed. Rep. of Germany

[21] Appl. No.: 318,968

[22] Filed: Mar. 6, 1989

[30] Foreign Application Priority Data

Mar. 14, 1988 [DE] Fed. Rep. of Germany ..... 8803428

[51] Int. Cl.[5] ..... H04R 25/00

[52] U.S. Cl. ..... 381/69.2; 381/68.7; 381/69

[58] Field of Search ..... 381/69, 69.1, 69.2, 381/68.7

[56] References Cited

U.S. PATENT DOCUMENTS

| | | | |
|---|---|---|---|
| 2,975,226 | 3/1961 | Lehr | 381/69.2 |
| 3,138,491 | 6/1964 | Rubio | 381/69.2 |
| 3,701,862 | 10/1972 | Vignini | 381/69.2 |

FOREIGN PATENT DOCUMENTS

| | | | |
|---|---|---|---|
| 0254925 | 2/1988 | European Pat. Off. . | |
| 2503253 | 1/1979 | Fed. Rep. of Germany . | |
| 3505390 | 8/1985 | Fed. Rep. of Germany . | |
| 3624568 | 1/1988 | Fed. Rep. of Germany | 381/69.2 |

*Primary Examiner*—Jin F. Ng
*Assistant Examiner*—Danita R. Byrd
*Attorney, Agent, or Firm*—Hill, Van Santen, Steadman & Simpson

[57] ABSTRACT

A hearing aid having a battery compartment pivotally attached thereto with a recess in the compartment for retaining therein a battery and a spring contact arrangement for coupling the battery to electrical components of the hearing aid, wherein a first spring contact engages a casing of the battery in abutting relationship, a second spring contact engages a face of the battery in abutting relationship only upon closure of the compartment, and an insulated spring arm engages the face of the battery to prevent inadvertent contacting of the second spring contact and the battery face unless the compartment is closed, the second spring contact being held in a preadjusted or prealigned position by an appropriate securing element.

20 Claims, 2 Drawing Sheets

HEARING AID COMPRISING A CONTACT SPRING ARRANGEMENT

BACKGROUND OF THE INVENTION

The present invention is directed generally to hearing aids. More specifically, the invention is directed to a contact arrangement for electrically connecting a battery power supply to electrical components of the hearing aid. Yet more specifically, the invention is directed to a spring contact arrangement wherein the battery power supply is carried in a compartment which is pivotally attached to the hearing aid housing and wherein pivoting of the compartment places the battery into contact with spring contacts to thereby provide electrical power to the electrical components of the hearing aid and to thereby turn on the hearing aid.

Due to space requirements, the turn on and turn off of known hearing aids, for example, the hearing aid disclosed in West German application No. DE-AS 25 03 253, frequently is accomplished not by means of a separately provided switch, but by means of a pivoting battery compartment. In No. DE-AS 25 03 253, a hearing aid assembly comprises a battery holder rotatably mounted about an axis perpendicular to a junction plane of halves of the housing. Two contacts are integrated in the housing in registry with the battery compartment so that as the battery compartment is pivoted, very much like a knife switch, the contacts contact a battery in the compartment on opposite sides of the battery, usually only when the battery is fully pivoted into the hearing aid housing. The battery is tablet-shaped with its poles located on opposite sides of the battery, or with the casing constituting one pole while one face constitutes another pole. The battery compartment includes a cylindrical bore into which the battery is positioned. The spring contacts are located on opposite sides of the battery compartment on walls of the housing so that the battery compartment and, accordingly, the battery, pivots between the spring contacts.

In a first position (the "on" position), when the battery is fully pivoted into the hearing aid housing, the hearing aid is switched on and the electrical components thereof are supplied with power and, accordingly, lie at voltage. In a second position (the "off" position), when the battery is partially pivoted out of the hearing aid housing, the battery contacts only one contact spring but the battery cannot be removed and cannot fall out of the battery compartment, since the battery compartment projects only partially out of the house. This second position is the "off" position because the electrical components of the housing are decoupled from the battery power supply. However, with certain unfavorable tilting of the battery, for example, if the battery is in a tilted position within the battery compartment, undesired contact in between the battery and the two spring contacts can occur. In a third position (the "change battery" position), the battery compartment is fully pivoted out from the hearing aid housing. In this position of the battery compartment, a battery can be removed from or inserted into the battery compartment.

SUMMARY OF THE INVENTION

The present invention provides a contact arrangement for a hearing aid wherein switching on and off of the hearing aid is accomplished by means of a pivoting battery compartment but, wherein, inadvertent contacting between the battery and the battery contact is prevented when the battery compartment is either in an "off" position or a "change of battery" position. To this end, in an embodiment, a hearing aid is provided with a pivoting battery compartment such that the battery contacts two spring contacts positioned in the hearing aid housing not in a knifing or wiping action manner, but in a direct contacting manner. A first spring contact contacts a side of the battery casing, while a second spring contact contacts a face of the battery, upon closure pivoting of the battery compartment. An insulating arm that projects from the hearing aid housing in close proximity to the second contact prevents contacting of the battery with the second spring contact when the battery compartment is in a position other than the closed position, i.e., the "on" position. The second spring contact is held in an adjusted or aligned position by an element securable to the hearing aid housing.

As a result of the utilization of this second spring contact with its simple fastening to the hearing aid housing, the assembly of the hearing aid with the second spring contact is accomplished without additional adjustment during the preliminary assembly thereof and/or the final assembly of the hearing aid.

In another embodiment, a fastening element, for example, a plastic clasp, is employed to hold the second spring contact in a prestressed position that corresponds to the adjusted position. In a preferred embodiment, the fastening element includes the resilient insulated arm that extends from the hearing aid housing to prevent the corresponding battery pole from contacting the second spring contact when the battery compartment is not fully closed so that only a single component is employed for both elements.

Accordingly, an advantage of the present invention is an improved spring contact arrangement for a hearing aid. A specific advantage of the invention is a spring contact arrangement for a hearing aid housing that prevents inadvertent contacting of a battery and therefore, inadvertent turning on of the hearing aid.

Yet a further advantage of the invention is a spring contact arrangement for a hearing aid that is easily and simply assembled.

DETAILED DESCRIPTION OF THE PRESENTLY PREFERRED EMBODIMENTS

Figure 2:
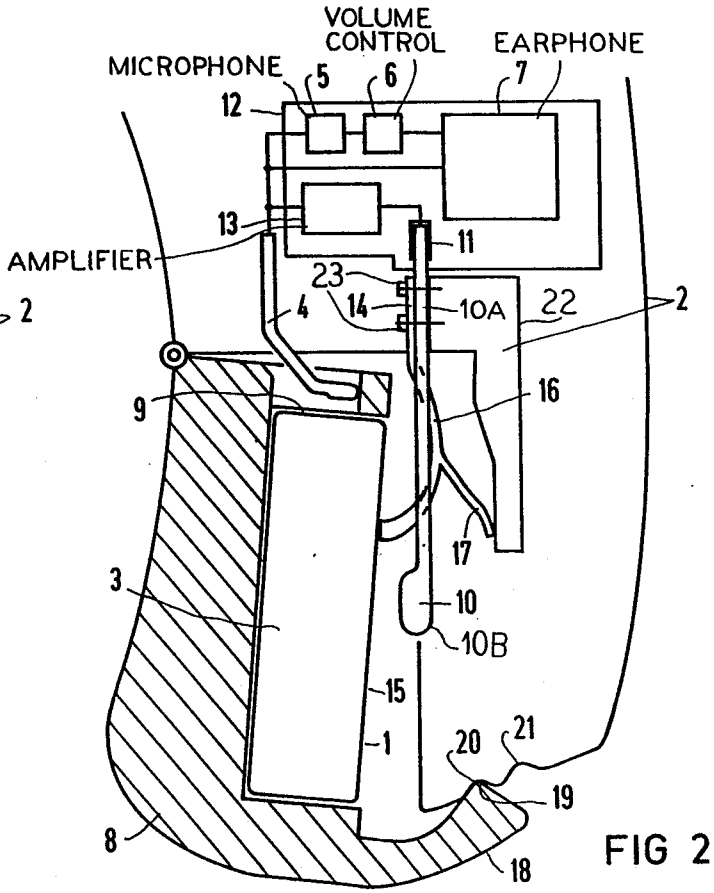
FIG. 2 is a fragmentary similar cross-sectional view of the hearing aid of FIG. 1, wherein the battery compartment is illustrated in an open position.
Figure 1:
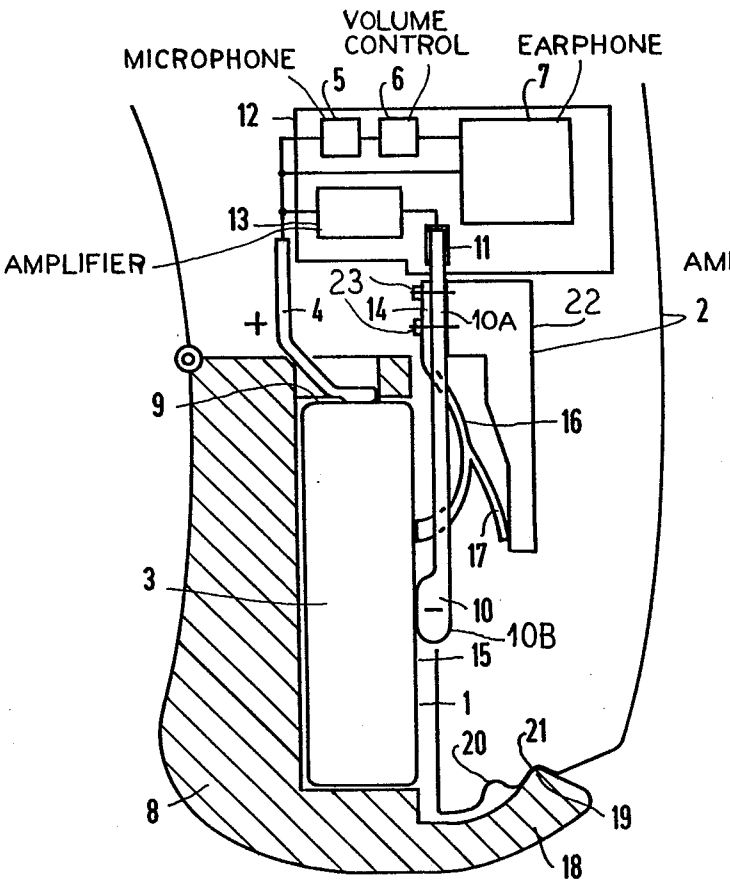
FIG. 1 is a fragmentary cross-sectional view of a hearing aid embodying principles of the invention illustrating in enlarged schematic form, the hearing aid having a closed battery compartment, whereby a battery is in contact with spring contacts of the hearing aid.

A hearing aid embodying principles of the invention as illustrated in FIGS. 1 and 2 and such hearing aid includes a hearing aid housing 2. Positioned within the hearing aid housing are hearing aid electronic components 5–7 such as a microphone and an earphone, as well as an amplifier 13, all located on a printed circuit board 12. The illustrated hearing aid is of the type that is designed to fit behind the ear and preferably is shell-shaped. However, the principles of the invention apply to other types of hearing aids as well.

At a distal end of the hearing aid housing 2 is pivotally attached a battery compartment 8 having a battery pocket or recess 1 within which is retained a pill or tablet-shaped battery 3. The battery 3 is utilized to supply the electronic components 5–7 and 13 with the necessary electrical power. The battery 3 has a casing 9 that constitutes the positive or plus pole and a large face 15 that constitutes the negative or minus pole.

A handle 18 is formed with the battery compartment 8 to provide a grasping element for pivoting of the compartment 8 between a first "on" position, a second "off" position, and a third "change battery" position. In the "on" position illustrated in FIG. 1, the battery compartment 8 is fully closed against the housing 2. In this position, electrical power is supplied to the electronic components 5–7 and 13. The battery compartment 8 is secured in the closed position by means of a protruding portion 19 on the handle 18 that cooperates with and is received in an appropriately formed recess 21 on the outside wall of the hearing aid housing 2.

In the "off" position, the battery compartment 8 is positioned in a slightly opened position such that the battery compartment 8 is pivoted slightly away from the housing 2. This position is illustrated most clearly in FIG. 2. In this position, the electrical power is decoupled from the electronic components 5–7 and 13. The battery compartment 8 is secured in this position by means of the protrusion 19 of the handle 18 that engages in and cooperates with an appropriately formed recess 20 on the outside wall of the housing 2.

In the "change battery" position, not illustrated, the battery compartment 8 is fully pivoted away from the housing 2 so that the battery 3 can be inserted into or removed from the battery compartment 8. In this position, the battery compartment 8 freely pivots as it is not secured in any one position by the protruding portion 19.

In the closed or "on" position, illustrated in FIG. 1, the battery compartment 8 is firmly latched to the housing 2 and the battery 3 is firmly seated within the battery pocket 1. The casing 9 abuts and is in electrical contact with a first spring contact element 4. The negative pole face 15 of the battery 3 abuts and is in electrical contact with contacting head portion 10B of a second spring contact element 10. Additionally, the battery face 15 abuts and presses against an insulating spring arm 16.

A straight arm portion 10A of the spring contact 10 is secured to the hearing aid housing 2 by means of an attaching element 14, for example, the illustrated clasp 14, that is secured to a bearing block 22 of the housing 2 by means of screws 23. In the illustrated embodiment, the insulating spring arm 16 and clasp 14 are formed as a unit. However, the arm 16 and clasp 14 can easily be separately formed, in which case the arm 16 and clasp 14 are simultaneously attached to the bearing block 22 with the screws 23.

The clasp 14, in cooperation with the bearing block 22 and screws 23, holds the spring contact 10 in a prescribed position and simultaneously adjusts or aligns the spring contact 10 to be subjected to prestress. For the purposes of simple assembly of the hearing aid, an end of the spring contact which is not in contact with the face 15 of the battery 3, is inserted into an appropriate receptor slot 11 of the printed circuit board 12, which receptor slot is electrically coupled to the amplifier 13. Accordingly, the electronic components 5–7 and 13 reside in a closed circuit arrangement to which a separate on/off switching arrangement can be added.

The illustrated hearing aid is assembled in a simple manner. To this end, the spring contact 10 is inserted into the receptor slot 11 of the printed circuit board 12. Then the board 12 and the spring contact 10 are inserted into the housing 2 of the hearing aid. At this point, the clasp 14 can be inserted into the housing 2 and secured against the bearing block 22 by means of the screws 23, simultaneously securing the spring contact 10 therebetween. Alternatively, the housing 2 can first be closed with the battery compartment 8 in the open position, the clasp 14 can then be inserted into the housing 2 and then secured against the bearing block 22.

At this point, it should be noted that the bearing block 22 can be formed by injection molding simultaneously with the housing 2 or formed separately and then screwed or plugged onto the housing 2.

In any event, once the spring contact 10 is secured against the bearing block 22, it is placed in the allocated adjusted or aligned position. Then, whenever the battery compartment 8 is pivoted to its closed position, and any additional switch is closed, the battery 3 inserted in the pocket 1 is placed in abutting contact with the spring contacts 4 and 10 and the hearing aid is turned on.

When the hearing aid is turned off by pivoting the battery compartment 8 to the 'off' or 'change battery' positions, the battery 3 is decoupled from the spring contacts 4 and 10 by being distanced therefrom. The insulated spring arm 16 of the clasp 14 extends from the housing 2 and prevents the battery from coming into contact with at least the spring contact 10 should the battery 3 be in a tilted position. This is accomplished because the spring arm 16 extends outward from the housing 2 beyond the contact 10 as illustrated best in FIG. 2. For reinforcing of the spring arm 16, the spring arm 16 is preferably, as illustrated, provided with a supporting spring element 17 that engages against an inside surface of the housing 2 and that biases the spring arm 16 outward from the housing 2 against the face 15 of the battery 3 whenever the battery compartment 8 is pivoted to the closed position. It should be understood that whenever the compartment 8 is in a position other than the closed position, the spring arm 16 will partially project out from the housing 2 due to such biasing.

Figure 3:
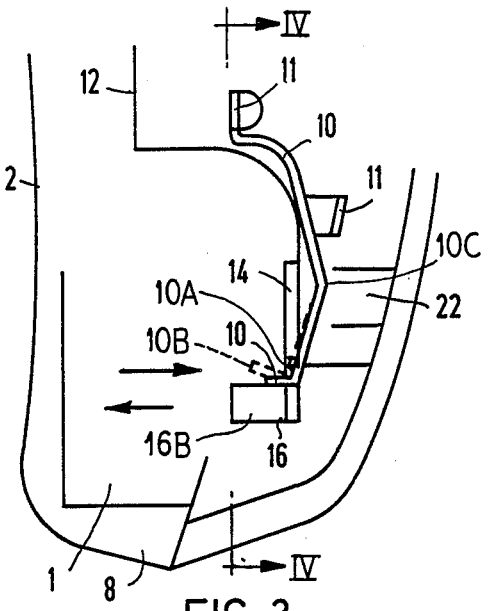
FIG. 3 is a cross-sectional view similar to that of FIG. 1 illustrating an alternate contact spring arrangement embodying principles of the invention.
Figure 4:
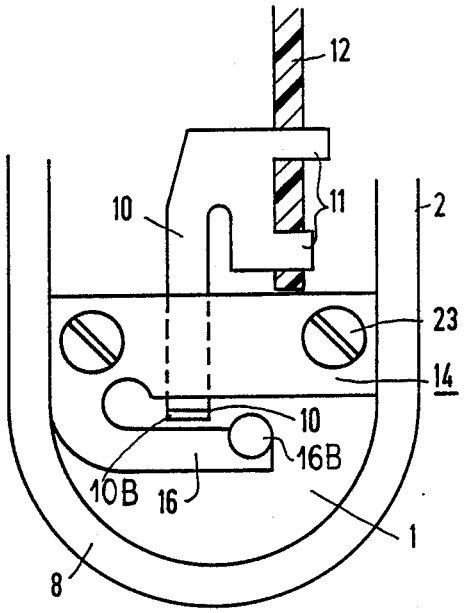
FIG. 4 is a cross-sectional view of the hearing aid of FIG. 3, taken generally along the line IV—IV.

An alternate contact arrangement embodying principle of the invention is illustrated in FIGS. 3 and 4. Therein the spring contact 10 is formed so as to have a bend 10A at its contacting end so as to have a downwardly depending leg 10B. Moreover, the spring contact 10 includes a bend 10C so as to impart a slightly accurate shape to the contact 10.

An alternate spring arm 16 is also shown in FIGS. 3 and 4. Therein the spring arm 16 is horizontally disposed relative to the downwardly depending leg 10B. The alternate spring arm 16 includes a downwardly depending head portion 16B that, absent closure of the battery compartment 8, extends below the downwardly depending contacting head portion 10B. The alternate spring arm 16 does not require an extra biasing arm due to the natural springing or resliency of the horizontal structure of the relatively horizontal spring arm 16. However, as illustrated, the securing element 14 and the alternate spring arm 16 are formed as a single unit and are used to retain the spring contact 10 with the housing 2.

It can also be seen that at the non-battery contacting end of the spring contact 10, the spring contact 10 is formed so as to have two members 11 that engage the circuit board 12 so as to compare the battery 3 to the illustrated hearing aid arrangements on the board 12. The members 11 engage appropriately formed slots on the board 12.

While a preferred embodiment has been shown, modifications and changes may become apparent to those skilled in the art which shall fall within the spirit and scope of the invention. It is intended that such modifications and changes be covered by the attached claims.

I claim:

1. A hearing aid comprising:

(a) a housing;

(b) a battery compartment member pivotally attached to said housing, said compartment member having a recess adapted for receiving therein a battery, said compartment being adapted to pivot between closed and not closed positions;

(c) electrical hearing aid components positioned within said housing;

(d) a first contact positioned within said housing and adapted to contact a casing of said battery when said compartment is pivoted to its closed position;

(e) a second contact positioned within said housing and adapted to contact a face of said battery in substantially non-wiping relation when said compartment is pivoted to its closed position; and (f) an arm positioned within said housing, said arm being biased to extend out from said housing so as to prevent said contacting between said battery and said second contact whenever said battery compartment is in a position other than its closed position.

2. The hearing aid of claim 1, wherein said arm is an insulated arm.

3. The hearing aid of claim 1, wherein said first contact is a spring contact.

4. The hearing aid of claim 1, wherein said second contact is a spring contact.

5. The hearing aid of claim 1, wherein said arm is a spring arm.

6. The hearing aid of claim 1, wherein said battery contacts said first contact substantially in non-wiping relation.

7. The hearing aid of claim 1, wherein said arm includes a supporting member that biases said arm out from said housing.

8. The hearing aid of claim 1, wherein the second spring is held in an aligned position by means of an element securable to the housing.

9. The hearing aid of claim 3, wherein the element for securing the second spring contact to the housing comprises a plastic clasp.

10. A hearing aid comprising:

(a) a housing member;

(b) electrical hearing aid components arranged within said housing;

(c) a battery compartment member pivotally attached to said housing member, said compartment member pivoting between closed and opened positions;

(d) first contact means positioned within said housing member and adapted for coupling said electrical hearing aid components to said battery substantially in a non-wiping manner;

(e) second contact means positioned within said housing member and adapted for coupling said electrical hearing aid components to said battery substantially in a non-wiping manner; and (f) means for extending from said housing when said compartment is not in its closed position to prevent contact between said battery and said second contact.

11. The hearing aid of claim 10, wherein means for extending from said housing to prevent contact between said battery and said second contact is an insulated arm.

12. The hearing aid of claim 10, wherein said second contact means is secured to said housing by means of a securing element.

13. The hearing aid of claim 12, further including a bearing block therein when a securing element is a clasp that attaches to said bearing block, securing the second contact means therebetween.

14. The hearing aid of claim 10, wherein the first and second contact means are spring contacts.

15. The hearing aid of claim 11, wherein said insulated arm is an insulated spring arm.

16. A hearing aid comprising:

(a) a housing;

(b) electrical components located within said housing;

(c) a battery compartment pivotally attached to said housing, said battery compartment being movable between open and closed positions, said battery compartment adapted to receive therein a battery;

(d) a first contact positioned within the housing and being electrically coupled on one end to said electrical components and being adapted for electrically coupling substantially in non-wiping fashion on another end to one pole of said battery when said compartment is in the closed position;

(e) a second contact positioned within the housing and being electrically coupled on one end to said electrical components and being adapted for electrically coupling substantially in non-wiping fashion on another end to an opposite pole of said battery only when said compartment is in the closed position; and (f) a spring arm positioned in said housing, said spring arm being secured on one end to said housing and positioned so as to prevent said second contact from contacting said battery whenever said compartment is in a position other than in the closed position.

17. The hearing aid of claim 16, wherein the first and second contacts are spring contacts.

18. The hearing aid of claim 17, wherein the housing includes a bearing block and wherein the spring arm is secured to the bearing block by means of a securing element.

19. The hearing aid of claim 16, wherein the spring arm is electrically insulating.

20. The hearing aid of claim 16, wherein the spring arm attached thereto is a supporting element that engages an inside surface of the housing and that biases the spring arm out from the housing.

* * * * *